US012649972B2

(12) United States Patent
Kashio et al.

(10) Patent No.: US 12,649,972 B2
(45) Date of Patent: Jun. 9, 2026

(54) CHEMICAL CONVERSION TREATMENT SOLUTION, CHEMICAL CONVERSION TREATMENT METHOD IN WHICH SAME IS USED, AND CHEMICAL CONVERSION COATING

(71) Applicant: DIPSOL CHEMICALS CO., LTD., Tokyo (JP)

(72) Inventors: Ryuta Kashio, Chiba (JP); Masatoshi Ishikawa, Chiba (JP); Tomitaka Yamamoto, Chiba (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 568 days.

(21) Appl. No.: 18/016,291

(22) PCT Filed: Jul. 19, 2021

(86) PCT No.: PCT/JP2021/026915
§ 371 (c)(1),
(2) Date: Jan. 13, 2023

(87) PCT Pub. No.: WO2022/024831
PCT Pub. Date: Feb. 3, 2022

(65) Prior Publication Data

US 2023/0304160 A1 Sep. 28, 2023

(30) Foreign Application Priority Data

Jul. 31, 2020 (JP) ..... 2020-130364

(51) Int. Cl.
*C23C 22/53* (2006.01)

(52) U.S. Cl.
CPC ..... *C23C 22/53* (2013.01); *C23C 2222/10* (2013.01)

(58) Field of Classification Search
CPC ..... C23C 22/53; C23C 2222/10; C23C 22/46; C23C 22/40
USPC ..... 148/267
See application file for complete search history.

(56) References Cited

U.S. PATENT DOCUMENTS

| | | | | |
|---|---|---|---|---|
| 2005/0194574 | A1* | 9/2005 | Yamamuro | C23C 22/44 106/287.18 |
| 2015/0135988 | A1* | 5/2015 | Yamaguchi | C08K 3/08 106/14.05 |
| 2019/0078214 | A1 | 3/2019 | Iwanaga et al. | |
| 2019/0136383 | A1 | 5/2019 | Saito et al. | |

FOREIGN PATENT DOCUMENTS

| | | | | |
|---|---|---|---|---|
| CN | 1729311 | A | 2/2006 | |
| CN | 104334770 | A | 2/2015 | |
| CN | 105579617 | A | 5/2016 | |
| CN | 109504961 | A | 3/2019 | |
| EP | 2 243 863 | A1 | 10/2010 | |
| JP | 2019-052351 | A | 4/2019 | |
| KR | 101858870 | B1 * | 6/2018 | C09D 5/084 |
| WO | WO-2016/104703 | A1 | 6/2016 | |

OTHER PUBLICATIONS

KR101858870B1 Translation (Year: 2018).*
Extended European Search Report for EP Application No. 21848974.8 dated Dec. 4, 2023, 8 pages.
Office Action for CN Application No. 202180050021.2 dated Feb. 8, 2025, 8 pages, English translation.

* cited by examiner

*Primary Examiner* — Danielle M. Carda
(74) *Attorney, Agent, or Firm* — Foley & Lardner LLP

(57) ABSTRACT

The present invention addresses the problem of providing a chemical conversion treatment solution that contains zirconium ions and that makes it possible to form a highly corrosion-resistant chemical conversion coating formed with consideration for the environment as well. The present invention provides a chemical conversion treatment solution that contains trivalent chromium ions, zirconium ions, aluminum ions, at least one type of carboxylic acid ions, and at least one type of silicon compound, the chemical conversion treatment solution being free of fluorine ions and fluorine compounds.

16 Claims, No Drawings

CHEMICAL CONVERSION TREATMENT SOLUTION, CHEMICAL CONVERSION TREATMENT METHOD IN WHICH SAME IS USED, AND CHEMICAL CONVERSION COATING

CROSS REFERENCE TO RELATED APPLICATIONS

This application is a U.S. National Phase Application under 35 U.S.C. § 371 of International Application No. PCT/JP2021/026915, filed on Jul. 19, 2021, which claims the benefit of and priority to Japanese Patent Application No. JP2020-130364, filed on Jul. 31, 2020, the contents of each of which are incorporated herein by reference in their entireties.

The present invention relates to a chemical conversion treatment solution and a chemical conversion treatment method and a chemical conversion coating using the same.

TECHNICAL FIELD

In related art, there have been trivalent chromium chemical conversion treatment agents not using cobalt from the viewpoint of environmental regulations, and many of them use zirconium as a substitute for cobalt (International Publication No. WO2016/104703, Japanese Patent Application Publication No. 2019-52351, and so on). Since zirconium ions are unstable in a treatment agent without fluorine, a fluoride has been conventionally used as a supply source for zirconium ions. However, there is a demand for treatment agents not using fluorine due to environmental concerns and the like.

CITATION LIST

Patent Literatures

Patent Literature 1: International Publication No. WO2016/104703

Patent Literature 2: Japanese Patent Application Publication No. 2019-52351

SUMMARY OF INVENTION

Problems to be Solved by the Invention

In view of the foregoing current circumstances, the present invention has an object to provide a chemical conversion treatment solution comprising zirconium ions that is capable of forming an environmentally-friendly high corrosion-resistant chemical conversion coating.

Means for Solution of the Problems

As a result of conducting earnest studies to achieve the above object, the present inventors have completed the present invention.

Specifically, the present invention provides the followings.

[1]

A chemical conversion treatment solution comprising:

trivalent chromium ions;

zirconium ions;

aluminum ions;

at least one type of carboxylate ions; and at least one type of silicon compounds, wherein the chemical conversion treatment solution contains no fluorine ions and fluorine compounds.

[2]

The chemical conversion treatment solution according to [1], wherein the at least one type of carboxylate ions comprise carboxylate ions capable of forming a complex with the trivalent chromium ions and carboxylate ions capable of forming a complex with the zirconium ions.

[3]

The chemical conversion treatment solution according to [1] or [2], wherein the at least one type of carboxylate ions comprise one or more types of carboxylate ions selected from the group consisting of dicarboxylate ions, hydroxy acid ions, and aldonic acid ions.

[4]

The chemical conversion treatment solution according to [3], wherein the dicarboxylate ions comprise one or more types of dicarboxylate ions selected from the group consisting of oxalate ions and malonate ions.

[5]

The chemical conversion treatment solution according to [3], wherein the hydroxy acid ions comprise one or more types of hydroxy acid ions selected from the group consisting of lactate ions, malate ions, citrate ions, tartrate ions, and glycolate ions.

[6]

The chemical conversion treatment solution according to [3], wherein the aldonic acid ions comprise one or more types of aldonic acid ions selected from the group consisting of gluconate ions, galactonate ions, and mannonic acid ions.

[7]

The chemical conversion treatment solution according to any one of [1] to [6], further comprising at least one type of oxidizing agent.

[8]

The chemical conversion treatment solution according to [7], wherein the at least one type of oxidizing agent comprises nitric acid and a nitrate that supply nitrate ions.

[9]

The chemical conversion treatment solution according to any one of [1] to [8], comprising no cobalt ions and cobalt compounds and/or no hexavalent chromium ions.

[10]

The chemical conversion treatment solution according to any one of [1] to [9], further comprising one or more types of preservatives selected from the group consisting of sorbic acid and salts thereof, isothiazolinone derivatives, dehydroacetic acid and salts thereof, and benzoic acid and salts thereof.

[11]

The chemical conversion treatment solution according to any one of [1] to [10], further comprising one or more types of water-soluble metal salts comprising a metal selected from the group consisting of V, Ti, W, Zr, Mn, Mo, Ta, Ce, Sr, and Fe.

[12]

The chemical conversion treatment solution according to any one of [1] to [11], further comprising one or more types of friction modifiers selected from the group consisting of surfactants and organic polymers.

[13]

The chemical conversion treatment solution according to any one of [1] to [12], wherein the at least one type of silicon compound comprises colloidal silica.

[14]

The chemical conversion treatment solution according to any one of [1] to [13], further comprising one or more types of organic acids or salts thereof selected from the group consisting of monocarboxylic acids or salts thereof, dicarboxylic acids or salts thereof, aromatic carboxylic acids or salts thereof, and amino acids or salts thereof.

[15]

A chemical conversion treatment method comprising bringing the chemical conversion treatment solution according to any one of [1] to [14] into contact with a surface of a metal base material.

[16]

The chemical conversion treatment method according to [15], wherein the metal base material or the surface thereof is of zinc or a zinc alloy.

[17]

A chemical conversion coating formed on a surface of a metal base material, wherein the chemical conversion coating is formed by using the chemical conversion treatment solution according to any one of [1] to [14].

[18]

A chemical conversion coating formed on a surface of a metal base material, comprising:

(a) a component selected from metallic chromium, trivalent chromium ions, and trivalent chromium compounds;

(b) a component selected from metallic zirconium, zirconium ions, and zirconium compounds;

(c) a component selected from metallic aluminum, aluminum ions, and aluminum compounds; and (d) a component selected from metallic silicon, silicon ions, and silicon compounds, wherein the chemical conversion coating comprises (e) no fluorine atoms, fluorine ions, and fluorine compounds.

[19]

The chemical conversion coating according to [18], wherein a content of the component (a) in the chemical conversion coating is 0.5 to 5 wt % in terms of chromium.

[20]

The chemical conversion coating according to [18] or [19], wherein a content of the component (d) in the chemical conversion coating is 2 to 20 wt % in terms of silicon.

[21]

The chemical conversion coating according to any one of [18] to [20], wherein a content of the component (b) in the chemical conversion coating is 0.05 to 5 wt % in terms of zirconium.

[22]

The chemical conversion coating according to any one of [18] to [21], wherein a content of the component (c) in the chemical conversion coating is more than 0 wt % and not more than 5 wt % in terms of aluminum.

[23]

The chemical conversion coating according to any one of [17] to [22], wherein the chemical conversion coating has a coating thickness of 0.1 to 1.5 μm.

[24]

The chemical conversion coating according to any one of [17] to [23], wherein the metal base material or the surface thereof is of zinc or a zinc alloy.

[25]

The chemical conversion coating according to any one of [17] to [24], comprising no metal cobalt, cobalt ions, and cobalt compounds.

DESCRIPTION OF EMBODIMENTS

A chemical conversion treatment solution of the present invention comprises trivalent chromium ions, zirconium ions, aluminum ions, at least one type of carboxylate ions, at least one type of oxidizing agent, and at least one type of silicon compound, comprises no fluorine ions and fluorine compounds, and comprises no hexavalent chromium ions.

The chemical conversion treatment solution of the present invention comprises trivalent chromium ions. Since the chemical conversion treatment solution comprises the trivalent chromium ions, excellent corrosion resistance can be achieved. The content of the trivalent chromium ions in the chemical conversion treatment solution is preferably 5 to 100 mmol/L. Using the trivalent chromium in such a low concentration range, the present invention is advantageous in wastewater treatment and an economical viewpoint. The content of the trivalent chromium ions in the chemical conversion treatment solution is more preferably 7 to 97 mmol/L, further preferably 8 to 96 mmol/L, and most preferably 15 to 39 mmol/L. A trivalent chromium compound to supply the trivalent chromium ions is not particularly limited but is preferably soluble in water. An example of the trivalent chromium compound is a trivalent chromium salt such as a chromium chloride, a chromium sulfate, a chromium nitrate, a chromium phosphate, or chromium acetate. Alternatively, hexavalent chromium ions of chromic acid or a dichromate can be reduced to trivalent chromium ions with a reducing agent. One type of the above trivalent chromium ions may be used alone or two or more of types of them may be used in combination.

The chemical conversion treatment solution of the present invention comprises zirconium ions. Since the chemical conversion treatment solution comprises the zirconium ions together with aluminum ions, the coating-thickening effect of the silicon compound can be obtained, and accordingly the corrosion resistance can be further enhanced. The content of the zirconium ions in the chemical conversion treatment solution is preferably 0.01 to 5 mmol/L, more preferably 0.05 to 2.2 mmol/L, further preferably 0.06 to 2.2 mmol/L, and most preferably 0.1 to 0.6 mmol/L. A zirconium compound to supply the zirconium ions is not particularly limited but is preferably soluble in water. Examples of the zirconium compound include inorganic zirconium compounds or salts thereof such as zirconium nitrate, zirconyl nitrate, ammonium zirconium nitrate, zirconyl chloride, zirconyl sulfate, zirconium carbonate, ammonium zirconyl carbonate, potassium zirconyl carbonate, sodium zirconyl carbonate, and lithium zirconyl carbonate and organozirconium compounds such as zirconyl acetate, zirconium lactate, zirconium tartrate, zirconium malate, and zirconium citrate. Preferable ones of the zirconium compound are zirconium nitrate and zirconyl chloride. One type of the above zirconium compounds may be used alone or two or more of types of them may be used in combination.

The chemical conversion treatment solution of the present invention comprises aluminum ions. Since the chemical conversion treatment solution comprises the aluminum ions together with the zirconium ions, the coating-thickening effect of the silicon compound can be obtained, and accordingly the corrosion resistance can be further enhanced. The content of the aluminum ions in the chemical conversion treatment solution is preferably 0.01 to 0.30 g/L, more preferably 0.02 to 0.30 g/L, and further preferably 0.04 to 0.11 g/L. An aluminum compound to supply the aluminum ions is not particularly limited but is preferably soluble in water. Examples of the aluminum compound include aluminum nitrate, aluminum chloride, aluminum sulfate, aluminum acetate, aluminum carbonate, and the like. Preferable ones of the aluminum compound are aluminum nitrate, aluminum chloride, and aluminum sulfate. One type of the above aluminum compounds may be used alone, or two or more of types of them may be used in combination.

The chemical conversion treatment solution of the present invention comprises at least one type of carboxylate ions. The total content of the zirconium ions in the chemical conversion treatment solution is preferably 8 to 132 mmol/L, more preferably 12.2 to 127 mmol/L, further preferably 20 to 52 mmol/L, and most preferably 21.2 to 52 mmol/L. The at least one type of carboxylate ions preferably comprise one or more types of carboxylate ions selected from the group consisting of dicarboxylate ions, hydroxy acid ions, and aldonic acid ions.

Examples of the dicarboxylate ions include oxalate ions, malonate ions, adipic acid ions, suberic acid ions, phthalic acid ions, isophthalic acid ions, terephthalic acid ions, fumaric acid ions, and the like.

Examples of the hydroxy acid ions include lactate ions, malate ions, citrate ions, tartrate ions, glycolate ions, hydroxybutyric acid ions, salicylic acid ions, gallate ions, coumarate ions, and the like. The hydroxy acid ions preferably comprise one or more types of hydroxy acid ions selected from the group consisting of lactate ions, malate ions, citrate ions, tartrate ions, and glycolate ions.

As the aldonic acid ions, there are gluconate ions, galactonate ions, mannonic acid ions, glycerate ions, ascorbate ions, xylonic acid ions, and the like. The aldonic acid ions preferably comprise one or more types of aldonic acid ions selected from the group consisting of gluconate ions, galactonate ions, and mannonic acid ions.

The at least one type of the carboxylate ions preferably comprise carboxylate ions capable of forming a complex with the trivalent chromium ions and carboxylate ions capable of forming a complex with the zirconium ions. Thus, complex formation of the carboxylate ions with the trivalent chromium ions and the zirconium ions makes it possible to stabilize the trivalent chromium ions and the zirconium ions. A mole ratio of the carboxylate ions capable of forming a complex with the trivalent chromium ions to the trivalent chromium ions (carboxylic acid/$Cr^{3+}$) is preferably 0.3 to 3.0, more preferably 0.3 to 2.2, and further preferably 0.5 to 2.0. Then, a mole ratio of the carboxylate ions capable of forming a complex with the zirconium ions to the zirconium ions (carboxylic acid/$Zr^{4+}$) is preferably 0.1 to 4.0, more preferably 0.5 to 4.0, further preferably 0.5 to 3.3, and most preferably 1.0 to 3.0. The carboxylate ions capable of forming a complex with the trivalent chromium ions comprise one or more types of dicarboxylate ions selected from the group consisting of oxalate ions and malonate ions. The carboxylate ions capable of forming a complex with the trivalent chromium ions are particularly preferably oxalate ions. The carboxylate ions capable of forming a complex with the zirconium ions are preferably of citric acid, lactic acid, gluconic acid, and the like.

The carboxylic acid or salt thereof to supply carboxylate ions is not particularly limited but is preferably soluble in water. Examples of the above carboxylic acid include oxalic acid, malonic acid, adipic acid, suberic acid, phthalic acid, isophthalic acid, terephthalic acid, fumaric acid, lactic acid, malic acid, citric acid, tartaric acid, glycolic acid, hydroxybutyric acid, salicylic acid, gallic acid, coumaric acid, gluconic acid, galactonic acid, mannonic acid, glyceric acid, ascorbic acid, xylonic acid, and the like. Examples of the carboxylic acid salt include salts of alkali metals such as potassium and sodium, salts of alkaline earth metals such as calcium and magnesium, ammonium salts, and the like. One type of the above carboxylic acids and salts thereof may be used alone, or two or more of types of them may be used in combination.

The chemical conversion treatment solution of the present invention may comprise at least one type of oxidizing agent. Comprising the oxidizing agent, the chemical conversion treatment solution makes it possible to promote the formation of the chemical conversion coating and obtain better appearance and corrosion resistance. The total content of the oxidizing agent in the chemical conversion treatment solution is preferably 0.5 to 30 g/L and more preferably 1.0 to 10 g/L. The oxidizing agent is not particularly limited but is preferably soluble in water. Examples of the oxidizing agent include nitric acid, nitrous acid, sulfuric acid, sulfurous acid, persulfuric acid, phosphoric acid, hydrochloric acid, bromic acid, chloric acid, hypochlorous acid, hydrogen peroxide, permanganic acid, metavanadic acid, tungstic acid, molybdic acid, salts of them, and the like. The oxidizing agent is preferably any of nitric acid and salts thereof to supply nitrate ions. A nitric acid compound to supply nitrate ions is not particularly limited but is preferably soluble in water. Examples of a nitrate include ammonium nitrate, sodium nitrate, potassium nitrate, lithium nitrate, chromium nitrate, aluminum nitrate, zirconyl nitrate, cobalt nitrate, and the like. One type of the above nitric acid and salts thereof may be used alone or two or more of types of them may be used in combination. The total content of the nitric acid and salts thereof in the chemical conversion treatment solution is preferably 1.5 to 20 g/L, more preferably 1.5 to 17.9 g/L, and further preferably 2.8 to 7.6 g/L in terms of nitrate ions.

The chemical conversion treatment solution of the present invention comprises at least one type of silicon compound. Comprising the silicon compound, the chemical conversion treatment solution makes it possible to obtain excellent corrosion resistance. The total content of the silicon compound in the chemical conversion treatment solution is preferably 0.5 to 11 g/L, more preferably 0.6 to 9.8 g/L, and further preferably 2 to 8.5 g/L in terms of silicon. The silicon compound is not particularly limited but is preferably soluble in water. Examples of the silicon compound include colloidal silica, silane coupling agent, sodium silicate, sodium orthosilicate, sodium metasilicate, potassium silicate, potassium metasilicate, lithium silicate, alkyl silicates, and the like. The silicon compound is preferably colloidal silica. The colloidal silica is not particularly limited and examples thereof include spherical colloidal silica, chain colloidal silica, and the like. The spherical colloidal silica is not particularly limited and examples thereof include: SNOWTEX XS, SNOWTEX S, SNOWTEX 30, SNOWTEX YL, SNOWTEX ZL, SNOWTEX OXS, SNOWTEX OS, SNOWTEX O, SNOWTEX OL, SNOWTEX OYL, SNOWTEX NXS, SNOWTEX NS, SNOWTEX N, SNOWTEX N-40, SNOWTEX CXS, SNOWTEX CS, and SNOWTEX C manufactured by Nissan Chemical Industries, Ltd., LUDOX FM, LUDOX SM, LUDOX HS-30, LUDOX HS-40, LUDOX HS-40FS, LUDOX TM-40, LUDOX TM-50, LUDOX PW-50, LUDOX AS-30, LUDOX AS-40, LUDOX AM, LUDOX TMA, and LUDOX HSA manufactured by GRACE, and the like. The chain colloidal silica is not particularly limited and examples thereof include SNOWTEX UP and SNOWTEX OUP manufactured by Nissan Chemical Industries, Ltd., and the like. All of them are available as commercial products. A particularly preferable one is spherical colloidal silica. One type of the above silicon compounds may be used alone or two or more of types of them may be used in combination.

The chemical conversion treatment solution of the present invention is a fluorine-free chemical conversion treatment solution comprising no fluorine ions and fluorine compounds. The fluorine ions or fluorine compounds are known to stabilize zirconium ions in a chemical conversion treatment solution and contribute to the coating-thickening effect of a silicon compound. In order to stabilize the zirconium ions, the chemical conversion treatment solution of the present invention comprises at least one type of carboxylate ions. Moreover, since the chemical conversion treatment solution comprises the zirconium ions and the aluminum ions, the coating-thickening effect of the silicon compound can be obtained, and accordingly the corrosion resistance can be further enhanced. Here, "comprising no fluorine ions and fluorine compounds" means that the value measured by a general fluorine analysis method is below a detection limit value. Examples of the analysis method include ion chromatography, lanthanum-alizarin complexion spectrophotometry, and the like.

The chemical conversion treatment solution of the present invention comprises no hexavalent chromium ions.

Without containing cobalt ions or cobalt compounds, the chemical conversion treatment solution of the present invention makes it possible to form an excellent corrosion-resistant coating. For this reason, the chemical conversion treatment solution of the present invention preferably comprises no cobalt ions and cobalt compounds. However, the chemical conversion treatment solution may contain cobalt ions or a cobalt compound. In the case where cobalt ions or a cobalt compound is contained, a content thereof in the chemical conversion treatment solution is preferably 300 mmol/L or less, more preferably 100 mmol/L or less, and further preferably 50 mmol/L or less in terms of Co. A cobalt compound to supply cobalt ions is not particularly limited but is preferably soluble in water. Examples of the cobalt compound include cobalt nitrate, cobalt chloride, cobalt sulfate, and the like. One type of the above cobalt compounds may be used alone or two or more of types of them may be used in combination.

The chemical conversion treatment solution of the present invention may comprise a preservative for mold prevention. The preservative is not particularly limited and examples thereof include sorbic acid and salts thereof, isothiazolinone derivatives, dehydroacetic acid and salts thereof, benzoic acid and salts thereof, and the like. One type of the above preservatives may be used alone or two or more of types of them may be used in combination. The content of the preservative in the chemical conversion treatment solution may be any amount as needed depending on the efficacy thereof. For example, in the case of a sorbate (potassium sorbate), the content thereof in the chemical conversion treatment solution is preferably 100 mg/L or less and more preferably 1 to 5 mg/L.

In order to further improve the corrosion resistance, the chemical conversion treatment solution of the present invention may further comprise a water-soluble metal salt comprising a metal selected from the group consisting of V, Ti, W, Zr, Mn, Mo, Ta, Ce, Sr, and Fe. Examples of the water-soluble metal salt include nitrates, chloride salts, sulfates, and the like. One type of the above water-soluble metal salts may be used alone or two or more of types of them may be used in combination. The content of the water-soluble metal salt in the chemical conversion treatment solution is preferably 0.1 g/L to 1.5 g/L and more preferably 0.2 g/L to 1.0 g/L.

The chemical conversion treatment solution of the present invention may comprise a friction modifier for controlling the friction of a surface of a chemical conversion coating formed. The friction modifier is not particularly limited and examples thereof include surfactants such as anionic surfactants, nonionic surfactants, and cationic surfactants, organic polymers such as polyethylene and polypropylene, and the like. One type of the above friction modifiers may be used alone or two or more of types of them may be used in combination. The content of the friction modifier in the chemical conversion treatment solution is preferably 1 mg/L to 5 g/L and more preferably 5 mg/L to 2 g/L.

The chemical conversion treatment solution of the present invention may comprise an organic acid or a salt thereof other than the carboxylic acid or salt thereof to supply the at least one type of carboxylate ions, as a buffer, a coating accelerator, a draining agent, an Fe dissolution inhibitor, or the like. The organic acid or salt thereof comprises one or more types of organic acids or salts thereof selected from the group consisting of monocarboxylic acids or salts thereof, dicarboxylic acids or salts thereof, aromatic dicarboxylic acids or salts thereof, and amino acids or salts thereof 10 Examples of the monocarboxylic acids include formic acid, acetic acid, and the like.

Examples of the dicarboxylic acids include succinic acid, glutaric acid, maleic acid, and the like.

Examples of the aromatic carboxylic acids include sulfosalicylic acid, cinnamic acid, and the like.

Examples of the amino acids include glutamic acid, aspartic acid, glycine, and the like.

Examples of the salts include salts of alkali metals such as potassium and sodium, salts of alkaline earth metals such as calcium and magnesium, ammonium salts, and the like One type of the above organic acids or salts thereof may be used alone or two or more of types of them may be used in combination. The content of the organic acid or salt thereof in the chemical conversion treatment solution is preferably 0.1 g/L to 20 g/L and more preferably 0.2 g/L to 10 g/L.

The chemical conversion treatment solution of the present invention has a pH in a range of 1.5 to 3.5 preferably and a range of 2.1 to 2.9 more preferably. In order to adjust the pH within the above range, an alkaline agent may be used, such as inorganic acid such as nitric acid and hydrochloric acid, organic acid, ammonia, ammonium salt, caustic alkali, sodium carbonate, potassium carbonate, or ammonium carbonate. When the pH is within the above range, it is possible to obtain excellent appearance and corrosion resistance.

A remainder other than the above components in the chemical conversion treatment solution of the present invention is water.

A method for forming a chemical conversion coating on a metal base material using the chemical conversion treatment solution of the present invention is not particularly limited and any known method is applicable. For example, the chemical conversion treatment solution is brought into contact with a surface of a metal base material in a method such as one including immersing the metal base material into the chemical conversion treatment solution. In the case of immersion, a temperature of the chemical conversion treatment solution is preferably 15 to 50° C. and more preferably 25 to 40° C. An immersion time is preferably 10 to 90 seconds and more preferably 15 to 50 seconds.

The metal base material for use in the present invention is not particularly limited and examples thereof include various metals such as iron, nickel, copper, zinc, and aluminum, alloys thereof, or the foregoing ones with metal-coated surfaces. The shape of the metal base material is not particularly limited and examples of the metal base material include various materials, namely, plate-shaped materials such as steel plate and plated steel plate, shaped materials in the shapes of rectangular parallelepipeds, solid cylinders, hollow cylinders, and spheres, and the like. Specific examples of the shaped materials include fastening parts such as bolts, nuts, and washers, pipe parts such as fuel pipes, cast iron parts such as brake calipers and common rails, as well as various other things such as connectors, plugs, housings, bases, and seat belt anchors.

A metal for coating the surface of the metal base material is not particularly limited but is preferably zinc or a zinc alloy. The coating is formed by zinc or zinc alloy plating in a conventional method. In order to deposit zinc plating on the metal base material, any of acid/neutral baths such as sulfuric acid bath, borofluoride bath, potassium chloride bath, sodium chloride bath, and ammonium chloride eclectic bath, and alkaline baths such as cyanide bath, zincate bath, and pyrophosphate bath may be used. Also, the zinc alloy plating may be performed in either an acid bath or an alkaline bath.

As the zinc alloy plating, there are zinc-iron alloy plating, zinc-nickel alloy plating, zinc-cobalt alloy plating, tin-zinc alloy plating, and the like. A preferable one is zinc-nickel alloy plating. A thickness of the plating deposited on the base material may be any, but may be 1 μm or more and preferably 5 to 25 μm.

In the present invention, after the plating is deposited on the base material in the above way, pretreatment such as washing with water or nitric acid activation treatment after washing with water is performed as necessary, and then chemical conversion treatment is performed in a method such, for example, as immersion treatment using the chemical conversion treatment solution of the present invention. In order to activate the plated surface, the base material may be immersed in a dilute nitric acid solution (such as 5% nitric acid), a dilute sulfuric acid solution, a dilute hydrochloric acid solution, a dilute hydrofluoric acid solution, or the like before the chemical conversion treatment. The conditions and treatment operations other than the above can be set and performed according to a conventional hexavalent chromate treatment method.

The coating formed by using the chemical conversion treatment solution of the present invention preferably comprises (1) no metal cobalt, cobalt ions, and cobalt compounds and/or comprises (2) no fluorine atoms, fluorine ions, and fluorine compounds.

Moreover, the chemical conversion coating of the present invention is a chemical conversion coating formed on a surface of a metal base material, comprising: (a) a component selected from metallic chromium, trivalent chromium ions, and trivalent chromium compounds; (b) a component selected from metallic zirconium, zirconium ions, and zirconium compounds; (c) a component selected from metallic aluminum, aluminum ions, and aluminum compounds; and (d) a component selected from metallic silicon, silicon ions, and silicon compounds, wherein the chemical conversion coating comprises (e) no fluorine atoms, fluorine ions, and fluorine compounds. The chemical conversion coating preferably comprises no metal cobalt, cobalt ions, and cobalt compounds.

The content of the component (a) in the chemical conversion coating is preferably 0.5 to 5 wt % and more preferably 1.7 to 3 wt % in terms of chromium.

The content of the component (b) in the chemical conversion coating is preferably 0.05 to 5 wt % and more preferably 0.1 to 3 wt % in terms of zirconium.

The content of the component (c) in the chemical conversion coating is preferably more than 0 wt % and not more than 5 wt % and more preferably more than 0 wt % and not more than 3 wt % in terms of aluminum.

The content of the component (d) in the chemical conversion coating is preferably 2 to 20 wt % and more preferably 7 to 15 wt % in terms of silicon.

The thickness of the chemical conversion coating of the present invention is preferably 0.1 to 1.5 μm and more preferably 0.2 to 1.2 μm.

Next, the invention will be described by using Examples and Comparative Examples, but the present invention should not be limited to these Examples.

EXAMPLES

Examples 1 to 31 and Comparative Examples 1 to 12

(Test Piece)

As a zinc-plated test piece, an M8 hexagonal bolt (material: iron) coated with zincate bath zinc plating (NZ-110 manufactured by Dipsole) with a thickness of 8 μm was used. The zinc-plated test piece was immersed for 10 seconds in a 1% nitric acid aqueous solution at a normal temperature, and then thoroughly rinsed with running tap water to clean the surfaces. After that, the zinc-plated test piece was subjected to chemical conversion treatment to be described below. The test piece after the chemical conversion treatment was thoroughly washed with tap water and ion-exchanged water and then was allowed to stand for 10 minutes in an electric drying furnace maintained at 80° C. for drying.

(Chemical Conversion Treatment Liquid)

The following three types of undiluted solutions were prepared in advance, and the chemical conversion treatment solutions specified in Tables 1 to 5 were prepared by mixing these undiluted solutions (Tables 6 and 7 specify compounds and product names used in Examples and Comparative Examples). After mixing, the pH was adjusted by using caustic soda.

An undiluted solution 1 was prepared by mixing the following compounds:

- a trivalent chromium compound;
- an aluminum compound (note that Comparative Examples 1 and 3 did not contain the aluminum compound, whereas Comparative Examples 4 to 11 used a cerium compound, a vanadium compound, a calcium compound, a magnesium compound, a titanium compound, a manganese compound, a nickel compound, and an iron compound, respectively, in place of the aluminum compound);
- carboxylic acid A;
- a nitrate (only in Examples 17 and 19); and
- water.

An undiluted solution 2 was prepared by mixing the following compounds (note that Comparative Example 12 did not use the undiluted solution 2):

- a zirconium compound;
- carboxylic acid B; and
- water.

An undiluted solution 3 was prepared by mixing the following compound:

- a silicon compound (note that Comparative Examples 1 and 2 did not contain the silicon compound); and
- water.

(Chemical Conversion Coating)

The test pieces were subjected to immersion treatment under the conditions specified in Tables 1 to 5 using the chemical conversion treatment solutions thus prepared.

(Appearance)

The appearance of the chemical conversion coating was evaluated from the viewpoints of consistency and gloss. Tables 1 to 5 show the results. The evaluation criteria were set as follows.

○ Good: glossy and consistent appearance

Δ Acceptable: Slightly low-gloss and consistent appearance x Poor: Cloudy, low-gloss, inconsistent appearance (Corrosion Resistance)

The test pieces after the chemical conversion treatment were subjected to a neutral salt spray test (hereinafter referred to as NSS) according to JIS Z-2371, and the corrosion resistance was evaluated by using a time in which occurrence of white rust was less than 5%. Tables 1 to 5 show the results.

(Zr Stability)

The Zr stability was evaluated depending on the presence or absence of precipitation in the chemical conversion treatment solution. Tables 1 to 5 show the results. The evaluation criteria were set as follows.

○ No precipitation

Δ Precipitation: Precipitation not affecting the effect of the present invention (acceptable range)

x Precipitation: Precipitation inhibiting the effect of the present invention (unusable: including cases where precipitation did not occur temporarily but occurred over time)

(Elemental Analysis of Chemical Conversion Coating)

The elemental composition of the chemical conversion coating was measured using an energy dispersive X-ray spectrometer (JEOL Ltd. JSM-6610 LA) on a cross section of the chemical conversion coating (Tables 8 to 11).

(Coating Thickness of Chemical Conversion Coating)

The coating thickness of the chemical conversion coating was measured by an X-ray photoelectron spectrometer. The coating thickness of each of Examples was 0.2 to 1.2 μm.

Comparative Example 1 is a chemical conversion treatment solution containing no aluminum ions and silicon compound and has inferior corrosion resistance. Comparative Example 2 is a chemical conversion treatment solution containing aluminum ions but no silicon compound and has inferior corrosion resistance (it is considered that the use of aluminum ions alone does not improve the corrosion resistance and the aluminum ions have no effect of imparting the corrosion resistance). Comparative Example 3 is a chemical conversion treatment solution containing the silicon compound but no aluminum ions and has inferior corrosion resistance (it is considered that the coating-thickening effect of the silicon compound is not exerted in the absence of aluminum ions). Comparative Examples 4 to 11 are chemical conversion treatment solutions containing the silicon compound with addition of metal ions other than the aluminum ions and have inferior corrosion resistance (the metal ions other than aluminum ions do not improve the corrosion resistance). Comparative Example 12 is a chemical conversion treatment solution containing the aluminum ions and the silicon compound but no zirconium ions, and has inferior corrosion resistance.

TABLE 1

| | | Example | | | | | | | |
|---|---|---|---|---|---|---|---|---|---|
| | | 1 | 2 | 3 | 4 | 5 | 6 | 7 | 8 |
| $Cr^{3+}$ (mmol/L) | | 23 | 23 | 23 | 8 | 15 | 39 | 96 | 39 |
| $Zr^{4+}$ (mmol/L) | | 0.1 | 0.3 | 0.6 | 2.2 | 0.1 | 0.6 | 0.06 | 0.1 |
| $Al^{3+}$ (g/L) | | 0.04 | 0.06 | 0.11 | 0.3 | 0.04 | 0.11 | 0.02 | 0.04 |
| $Ce^{4+}$ (g/L) | | | | | | | | | |
| $V^{4+}$ (g/L) | | | | | | | | | |
| $Ca^{2+}$ (g/L) | | | | | | | | | |
| $Mg^{2+}$ (g/L) | | | | | | | | | |
| $Ti^{4+}$ (g/L) | | | | | | | | | |
| $Mn^{2+}$ (g/L) | | | | | | | | | |
| $Ni^{2+}$ (g/L) | | | | | | | | | |
| $Fe^{3+}$ (g/L) | | | | | | | | | |
| Carboxylic acid A (mmol/L) | Oxalic acid<br>Malonic acid | 31 | 31 | 31 | 8 | 21 | 51 | 127 | 51 |
| Carboxylic acid B (mmol/L) | Citric acid<br>Lactic acid<br>Gluconic acid | 0.2 | 0.6 | 1 | 4.2 | 0.2 | 1 | 0.1 | 0.2 |
| $NO_3^-$ (g/L) | | 4.3 | 4.3 | 4.3 | 1.5 | 2.8 | 7.3 | 17.9 | 7.3 |
| Si (g/L) | | 4.2 | 4.2 | 4.2 | 4.2 | 4.2 | 4.2 | 4.2 | 4.2 |
| Carboxylic acid A + B (mmol/L) | | 31.2 | 31.6 | 32 | 12.2 | 21.2 | 52 | 127 | 51.2 |
| Carboxylic acid A/$Cr^{3+}$ mole ratio | | 1.3 | 1.3 | 1.3 | 1.0 | 1.4 | 1.3 | 1.3 | 1.3 |
| Carboxylic acid B/$Zr^{4+}$ mole ratio | | 2.0 | 2.0 | 1.7 | 1.9 | 2.0 | 1.7 | 1.7 | 2.0 |
| Treatment liquid pH | | 2.5 | 2.5 | 2.5 | 2.5 | 2.5 | 2.5 | 2.5 | 2.5 |
| Treatment temperature (° C.) | | 30 | 30 | 30 | 30 | 30 | 30 | 30 | 30 |
| Treatment time (sec) | | 30 | 30 | 30 | 30 | 30 | 30 | 30 | 30 |
| Appearance | | ○ | ○ | ○ | Δ | ○ | ○ | ○ | ○ |
| Corrosion resistance | | 120 | 168 | 192 | 192 | 96 | 192 | 72 | 168 |
| Treatment liquid stability | | ○ | ○ | ○ | Δ | ○ | ○ | ○ | ○ |

TABLE 2

| | | Example | | | | | | |
|---|---|---|---|---|---|---|---|---|
| | | 9 | 10 | 11 | 12 | 13 | 14 | 15 |
| $Cr^{3+}$ (mmol/L) | | 23 | 23 | 23 | 23 | 23 | 23 | 23 |
| $Zr^{4+}$ (mmol/L) | | 0.3 | 0.3 | 0.3 | 0.3 | 0.3 | 0.3 | 0.3 |
| $Al^{3+}$ (g/L) | | 0.06 | 0.06 | 0.06 | 0.06 | 0.06 | 0.06 | 0.06 |
| $Ce^{4+}$ (g/L) | | | | | | | | |
| $V^{4+}$ (g/L) | | | | | | | | |
| $Ca^{2+}$ (g/L) | | | | | | | | |
| $Mg^{2+}$ (g/L) | | | | | | | | |
| $Ti^{4+}$ (g/L) | | | | | | | | |
| $Mn^{2+}$ (g/L) | | | | | | | | |
| $Ni^{2+}$ (g/L) | | | | | | | | |
| $Fe^{3+}$ (g/L) | | | | | | | | |
| Carboxylic acid A | Oxalic acid | 21 | 51 | | | | 31 | 31 |
| (mmol/L) | Malonic acid | | | 21 | 31 | 51 | | |
| Carboxylic acid B | Citric acid | 0.15 | 1 | 0.6 | 0.6 | 0.6 | | |
| (mmol/L) | Lactic acid | | | | | | 1 | |
| | Gluconic acid | | | | | | | 1 |
| $NO_3^-$ (g/L) | | 4.3 | 4.3 | 4.3 | 4.3 | 4.3 | 4.3 | 4.3 |
| Si (g/L) | | 4.2 | 4.2 | 4.2 | 4.2 | 4.2 | 4.2 | 4.2 |
| Carboxylic acid A + B (mmol/L) | | 21.2 | 52 | 21.6 | 31.6 | 51.6 | 32 | 32 |
| Carboxylic acid A/$Cr^{3+}$ mole ratio | | 0.9 | 2.2 | 0.9 | 1.3 | 2.2 | 1.3 | 1.3 |
| Carboxylic acid B/$Zr^{4+}$ mole ratio | | 0.5 | 3.3 | 2.0 | 2.0 | 2.0 | 3.3 | 3.3 |
| Treatment liquid pH | | 2.5 | 2.5 | 2.5 | 2.5 | 2.5 | 2.5 | 2.5 |
| Treatment temperature (° C.) | | 30 | 30 | 30 | 30 | 30 | 30 | 30 |
| Treatment time (sec) | | 30 | 30 | 30 | 30 | 30 | 30 | 30 |
| Appearance | | ○ | ○ | ○ | ○ | ○ | ○ | ○ |
| Corrosion resistance | | 96 | 120 | 120 | 96 | 72 | 96 | 96 |
| Treatment liquid stability | | Δ | ○ | ○ | ○ | ○ | Δ | Δ |

TABLE 3

| | | Example | | | | | | | |
|---|---|---|---|---|---|---|---|---|---|
| | | 16 | 17 | 18 | 19 | 20 | 21 | 22 | 23 |
| $Cr^{3+}$ (mmol/L) | | 23 | 23 | 23 | 23 | 23 | 23 | 23 | 23 |
| $Zr^{4+}$ (mmol/L) | | 0.3 | 0.3 | 0.3 | 0.3 | 0.3 | 0.3 | 0.6 | 0.6 |
| $Al^{3+}$ (g/L) | | 0.06 | 0.06 | 0.06 | 0.06 | 0.06 | 0.06 | 0.11 | 0.11 |
| $Ce^{4+}$ (g/L) | | | | | | | | | |
| $V^{4+}$ (g/L) | | | | | | | | | |
| $Ca^{2+}$ (g/L) | | | | | | | | | |
| $Mg^{2+}$ (g/L) | | | | | | | | | |
| $Ti^{4+}$ (g/L) | | | | | | | | | |
| $Mn^{2+}$ (g/L) | | | | | | | | | |
| $Ni^{2+}$ (g/L) | | | | | | | | | |
| $Fe^{3+}$ (g/L) | | | | | | | | | |
| Carboxylic acid A | Oxalic acid | 31 | 31 | 31 | 31 | 31 | 31 | 31 | 31 |
| (mmol/L) | Malonic acid | | | | | | | | |
| Carboxylic acid B | Citric acid | 0.6 | 0.6 | 0.6 | 0.6 | 0.6 | 0.6 | 1 | 1 |
| (mmol/L) | Lactic acid | | | | | | | | |
| | Gluconic acid | | | | | | | | |
| $NO_3^-$ (g/L) | | 4.8 | 7.6 | 1.7 | 12.9 | 4.3 | 4.3 | 4.4 | 4.4 |
| Si (g/L) | | 4.2 | 4.2 | 4.2 | 4.2 | 2.1 | 8.4 | 0.6 | 9.8 |
| Carboxylic acid A + B (mmol/L) | | 31.6 | 31.6 | 31.6 | 31.6 | 31.6 | 31.6 | 32 | 32 |
| Carboxylic acid A/$Cr^{3+}$ mole ratio | | 1.3 | 1.3 | 1.3 | 1.3 | 1.3 | 1.3 | 1.3 | 1.3 |
| Carboxylic acid B/$Zr^{4+}$ mole ratio | | 2.0 | 2.0 | 2.0 | 2.0 | 2.0 | 2.0 | 1.7 | 1.7 |
| Treatment liquid pH | | 2.5 | 2.5 | 2.5 | 2.5 | 2.5 | 2.5 | 2.5 | 2.5 |
| Treatment temperature (° C.) | | 30 | 30 | 30 | 30 | 30 | 30 | 30 | 30 |
| Treatment time (sec) | | 30 | 30 | 30 | 30 | 30 | 30 | 30 | 30 |
| Appearance | | ○ | ○ | Δ | Δ | ○ | ○ | ○ | Δ |
| Corrosion resistance | | 168 | 168 | 168 | 168 | 96 | 168 | 72 | 192 |
| Treatment liquid stability | | ○ | ○ | ○ | ○ | ○ | ○ | ○ | ○ |

TABLE 4

| | | Example | | | | | | | |
|---|---|---|---|---|---|---|---|---|---|
| | | 24 | 25 | 26 | 27 | 28 | 29 | 30 | 31 |
| $Cr^{3+}$ (mmol/L) | | 23 | 23 | 23 | 23 | 23 | 23 | 23 | 23 |
| $Zr^{4+}$ (mmol/L) | | 0.3 | 0.3 | 0.3 | 0.3 | 0.3 | 0.3 | 0.3 | 0.3 |
| $Al^{3+}$ (g/L) | | 0.06 | 0.06 | 0.06 | 0.06 | 0.06 | 0.06 | 0.06 | 0.06 |
| $Ce^{4+}$ (g/L) | | | | | | | | | |
| $V^{4+}$ (g/L) | | | | | | | | | |
| $Ca^{2+}$ (g/L) | | | | | | | | | |
| $Mg^{2+}$ (g/L) | | | | | | | | | |
| $Ti^{4+}$ (g/L) | | | | | | | | | |
| $Mn^{2+}$ (g/L) | | | | | | | | | |
| $Ni^{2+}$ (g/L) | | | | | | | | | |
| $Fe^{3+}$ (g/L) | | | | | | | | | |
| Carboxylic acid A (mmol/L) | Oxalic acid | 31 | 31 | 31 | 31 | 31 | 31 | 31 | 31 |
| | Malonic acid | | | | | | | | |
| Carboxylic acid B (mmol/L) | Citric acid | 0.6 | 0.6 | 0.6 | 0.6 | 0.6 | 0.6 | 0.6 | 0.6 |
| | Lactic acid | | | | | | | | |
| | Gluconic acid | | | | | | | | |
| $NO_3^-$ (g/L) | | 4.3 | 4.3 | 4.3 | 4.3 | 4.3 | 4.3 | 4.3 | 4.3 |
| Si (g/L) | | 4.2 | 4.2 | 4.2 | 4.2 | 4.2 | 4.2 | 4.2 | 4.2 |
| Carboxylic acid A + B (mmol/L) | | 31.6 | 31.6 | 31.6 | 31.6 | 31.6 | 31.6 | 31.6 | 31.6 |
| Carboxylic acid A/$Cr^{3+}$ mole ratio | | 1.3 | 1.3 | 1.3 | 1.3 | 1.3 | 1.3 | 1.3 | 1.3 |
| Carboxylic acid B/$Zr^{4+}$ mole ratio | | 2.0 | 2.0 | 2.0 | 2.0 | 2.0 | 2.0 | 2.0 | 2.0 |
| Treatment liquid pH | | 2.1 | 1.5 | 2.9 | 3.5 | 2.5 | 2.5 | 2.5 | 2.5 |
| Treatment temperature (° C.) | | 30 | 30 | 30 | 30 | 25 | 15 | 40 | 50 |
| Treatment time (sec) | | 30 | 30 | 30 | 30 | 15 | 10 | 50 | 90 |
| Appearance | | ○ | Δ | ○ | Δ | ○ | ○ | ○ | Δ |
| Corrosion resistance | | 168 | 168 | 120 | 72 | 96 | 72 | 192 | 192 |
| Treatment liquid stability | | ○ | ○ | ○ | ○ | ○ | ○ | ○ | ○ |

TABLE 5

| | | Comparative Example | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| $Cr^{3+}$ (mmol/L) | | 23 | 23 | 23 | 23 | 23 | 23 | 23 | 23 | 23 | 23 | 23 | 23 |
| $Zr^{4+}$ (mmol/L) | | 0.3 | 0.3 | 0.3 | 0.3 | 0.3 | 0.3 | 0.3 | 0.3 | 0.3 | 0.3 | 0.3 | |
| $Al^{3+}$ (g/L) | | | 0.06 | | | | | | | | | | 0.11 |
| $Ce^{4+}$ (g/L) | | | | | 0.35 | | | | | | | | |
| $V^{4+}$ (g/L) | | | | | | 0.26 | | | | | | | |
| $Ca^{2+}$ (g/L) | | | | | | | 0.10 | | | | | | |
| $Mg^{2+}$ (g/L) | | | | | | | | 0.06 | | | | | |
| $Ti^{4+}$ (g/L) | | | | | | | | | 0.10 | | | | |
| $Mn^{2+}$ (g/L) | | | | | | | | | | 0.11 | | | |
| $Ni^{2+}$ (g/L) | | | | | | | | | | | 0.06 | | |
| $Fe^{3+}$ (g/L) | | | | | | | | | | | | 0.28 | |
| Carboxylic acid A (mmol/L) | Oxalic acid | 31 | 31 | 31 | 31 | 31 | 31 | 31 | 31 | 31 | 31 | 31 | 31 |
| | Malonic acid | | | | | | | | | | | | |
| Carboxylic acid B (mmol/L) | Citric acid | 0.6 | 0.6 | 0.6 | 0.6 | 0.6 | 0.6 | 0.6 | 0.6 | 0.6 | 0.6 | 0.6 | |
| | Lactic acid | | | | | | | | | | | | |
| | Gluconic acid | | | | | | | | | | | | |
| $NO_3^-$ (g/L) | | 4.3 | 4.3 | 4.3 | 4.3 | 4.3 | 4.3 | 4.3 | 4.3 | 4.3 | 4.3 | 4.3 | 4.3 |
| Si (g/L) | | — | — | 4.2 | 4.2 | 4.2 | 4.2 | 4.2 | 4.2 | 4.2 | 4.2 | 4.2 | 4.2 |
| Carboxylic acid A + B (mmol/L) | | 31.6 | 31.6 | 31.6 | 31.6 | 31.6 | 31.6 | 31.6 | 31.6 | 31.6 | 31.6 | 31.6 | 31 |
| Carboxylic acid A/$Cr^{3+}$ mole ratio | | 1.3 | 1.3 | 1.3 | 1.3 | 1.3 | 1.3 | 1.3 | 1.3 | 1.3 | 1.3 | 1.3 | 1.3 |
| Carboxylic acid B/$Zr^{4+}$ mole ratio | | 2.0 | 2.0 | 2.0 | 2.0 | 2.0 | 2.0 | 2.0 | 2.0 | 2.0 | 2.0 | 2.0 | — |
| Treatment liquid pH | | 2.5 | 2.5 | 2.5 | 2.5 | 2.5 | 2.5 | 2.5 | 2.5 | 2.5 | 2.5 | 2.5 | 2.5 |
| Treatment temperature (° C.) | | 30 | 30 | 30 | 30 | 30 | 30 | 30 | 30 | 30 | 30 | 30 | 30 |
| Treatment time (sec) | | 30 | 30 | 30 | 30 | 30 | 30 | 30 | 30 | 30 | 30 | 30 | 30 |
| Appearance | | ○ | ○ | ○ | ○ | ○ | ○ | ○ | ○ | ○ | ○ | ○ | ○ |
| Corrosion resistance | | 48 | 48 | 48 | 48 | 48 | 48 | 48 | 48 | 48 | 48 | 48 | 48 |
| Treatment liquid stability | | ○ | ○ | ○ | ○ | ○ | ○ | ○ | ○ | ○ | ○ | X | ○ |

TABLE 6

| | Chromium | Zr | Al | Carboxylic acid A |
|---|---|---|---|---|
| Example 1 | 40% chromium nitrate solution | Zirconyl chloride octahydrate | Aluminum chloride hexahydrate | Oxalic acid monohydrate |
| Example 2 | 40% chromium nitrate solution | Zirconyl chloride octahydrate | Aluminum chloride hexahydrate | Oxalic acid monohydrate |
| Example 3 | 40% chromium nitrate solution | Zirconyl chloride octahydrate | Aluminum chloride hexahydrate | Oxalic acid monohydrate |
| Example 4 | 40% chromium nitrate solution | Zirconyl chloride octahydrate | Aluminum chloride hexahydrate | Oxalic acid monohydrate |
| Example 5 | 40% chromium nitrate solution | Zirconyl chloride octahydrate | Aluminum chloride hexahydrate | Oxalic acid monohydrate |
| Example 6 | 40% chromium nitrate solution | Zirconyl chloride octahydrate | Aluminum chloride hexahydrate | Oxalic acid monohydrate |
| Example 7 | 40% chromium nitrate solution | Zirconyl chloride octahydrate | Aluminum chloride hexahydrate | Oxalic acid monohydrate |
| Example 8 | 40% chromium nitrate solution | Zirconyl chloride octahydrate | Aluminum chloride hexahydrate | Oxalic acid monohydrate |
| Example 9 | 40% chromium nitrate solution | Zirconyl chloride octahydrate | Aluminum chloride hexahydrate | Oxalic acid monohydrate |
| Example 10 | 40% chromium nitrate solution | Zirconyl chloride octahydrate | Aluminum chloride hexahydrate | Oxalic acid monohydrate |
| Example 11 | 40% chromium nitrate solution | Zirconyl chloride octahydrate | Aluminum chloride hexahydrate | Malonic acid |
| Example 12 | 40% chromium nitrate solution | Zirconyl chloride octahydrate | Aluminum chloride hexahydrate | Malonic acid |
| Example 13 | 40% chromium nitrate solution | Zirconyl chloride octahydrate | Aluminum chloride hexahydrate | Malonic acid |
| Example 14 | 40% chromium nitrate solution | Zirconyl chloride octahydrate | Aluminum chloride hexahydrate | Oxalic acid monohydrate |
| Example 15 | 40% chromium nitrate solution | Zirconyl chloride octahydrate | Aluminum chloride hexahydrate | Oxalic acid monohydrate |
| Example 16 | 40% chromium nitrate solution | Zirconyl nitrate dihydrate | Aluminum nitrate nonahydrate | Oxalic acid monohydrate |
| Example 17 | 40% chromium nitrate solution | Zirconyl nitrate dihydrate | Aluminum nitrate nonahydrate | Oxalic acid monohydrate |
| Example 18 | 35% chromium chloride solution | Zirconyl nitrate dihydrate | Aluminum nitrate nonahydrate | Oxalic acid monohydrate |
| Example 19 | 40% chromium sulfate solution | Zirconyl chloride octahydrate | Aluminum nitrate nonahydrate | Oxalic acid monohydrate |
| Example 20 | 40% chromium nitrate solution | Zirconyl chloride octahydrate | Aluminum chloride hexahydrate | Oxalic acid monohydrate |
| Example 21 | 40% chromium nitrate solution | Zirconyl chloride octahydrate | Aluminum chloride hexahydrate | Oxalic acid monohydrate |
| Example 22 | 40% chromium nitrate solution | Zirconyl chloride octahydrate | Aluminum chloride hexahydrate | Oxalic acid monohydrate |

| | Carboxylic acid B | $NO^{3-}$ | Si (Product name) |
|---|---|---|---|
| Example 1 | Citric acid monohydrate | | SNOWTEX N |
| Example 2 | Citric acid monohydrate | | SNOWTEX 30 |
| Example 3 | Citric acid monohydrate | | SNOWTEX O |
| Example 4 | Citric acid monohydrate | | SNOWTEX OS |
| Example 5 | Citric acid monohydrate | | SNOWTEX NS |
| Example 6 | Citric acid monohydrate | | SNOWTEX N |
| Example 7 | Citric acid monohydrate | | SNOWTEX OS |
| Example 8 | Citric acid monohydrate | | SNOWTEX N |
| Example 9 | Citric acid monohydrate | | SNOWTEX OS |
| Example 10 | Citric acid monohydrate | | SNOWTEX O |
| Example 11 | Citric acid monohydrate | | SNOWTEX NS |
| Example 12 | Citric acid monohydrate | | SNOWTEX 30 |
| Example 13 | Citric acid monohydrate | | SNOWTEX OS |
| Example 14 | 50% Synthesized Lactic acid | | SNOWTEX N |
| Example 15 | Gluconic acid | | SNOWTEX O |
| Example 16 | Citric acid monohydrate | | SNOWTEX 30 |
| Example 17 | Citric acid monohydrate | Sodium nitrate | SNOWTEX OS |
| Example 18 | Citric acid monohydrate | | SNOWTEX O |
| Example 19 | Citric acid monohydrate | Ammonium nitrate | SNOWTEX NS |
| Example 20 | Citric acid monohydrate | | SNOWTEX N |
| Example 21 | Citric acid monohydrate | | SNOWTEX O |
| Example 22 | Citric acid monohydrate | | SNOWTEX 30 |

TABLE 7

| | Chromium | Zr | Al | Metal other than Al |
|---|---|---|---|---|
| Example 23 | 40% chromium nitrate solution | Zirconyl chloride octahydrate | Aluminum chloride hexahydrate | |
| Example 24 | 40% chromium nitrate solution | Zirconyl chloride octahydrate | Aluminum chloride hexahydrate | |
| Example 25 | 40% chromium nitrate solution | Zirconyl chloride octahydrate | Aluminum chloride hexahydrate | |
| Example 26 | 40% chromium nitrate solution | Zirconyl chloride octahydrate | Aluminum chloride hexahydrate | |
| Example 27 | 40% chromium nitrate solution | Zirconyl chloride octahydrate | Aluminum chloride hexahydrate | |
| Example 28 | 40% chromium nitrate solution | Zirconyl chloride octahydrate | Aluminum chloride hexahydrate | |
| Example 29 | 40% chromium nitrate solution | Zirconyl chloride octahydrate | Aluminum chloride hexahydrate | |
| Example 30 | 40% chromium nitrate solution | Zirconyl chloride octahydrate | Aluminum chloride hexahydrate | |
| Example 31 | 40% chromium nitrate solution | Zirconyl chloride octahydrate | Aluminum chloride hexahydrate | |
| Comp. Ex. 1 | 40% chromium nitrate solution | Zirconyl chloride octahydrate | | |
| Comp. Ex. 2 | 40% chromium nitrate solution | Zirconyl chloride octahydrate | Aluminum chloride hexahydrate | |
| Comp. Ex. 3 | 40% chromium nitrate solution | Zirconyl chloride octahydrate | | |
| Comp. Ex. 4 | 40% chromium nitrate solution | Zirconyl chloride octahydrate | | Cerium sulfate tetrahydrate |
| Comp. Ex. 5 | 40% chromium nitrate solution | Zirconyl chloride octahydrate | | Vanadium oxysulfate |
| Comp. Ex. 6 | 40% chromium nitrate solution | Zirconyl chloride octahydrate | | Calcium chloride dihydrate |
| Comp. Ex. 7 | 40% chromium nitrate solution | Zirconyl chloride octahydrate | | Magnesium chloride hexahydrate |
| Comp. Ex. 8 | 40% chromium nitrate solution | Zirconyl chloride octahydrate | | Titanyl sulfate |
| Comp. Ex. 9 | 40% chromium nitrate solution | Zirconyl chloride octahydrate | | Manganese chloride tetrahydrate |
| Comp. Ex. 10 | 40% chromium nitrate solution | Zirconyl chloride octahydrate | | Nickel chloride hexahydrate |
| Comp. Ex. 11 | 40% chromium nitrate solution | Zirconyl chloride octahydrate | | Iron(III) nitrate nonahydrate |
| Comp. Ex. 12 | 40% chromium nitrate solution | | Aluminum chloride hexahydrate | |

TABLE 7-continued

| | Carboxylic acid A | Carboxylic acid B | Si (Product name) |
|---|---|---|---|
| Example 23 | Oxalic acid monohydrate | Citric acid monohydrate | SNOWTEX NS |
| Example 24 | Oxalic acid monohydrate | Citric acid monohydrate | SNOWTEX OS |
| Example 25 | Oxalic acid monohydrate | Citric acid monohydrate | SNOWTEX O |
| Example 26 | Oxalic acid monohydrate | Citric acid monohydrate | SNOWTEX 30 |
| Example 27 | Oxalic acid monohydrate | Citric acid monohydrate | SNOWTEX OS |
| Example 28 | Oxalic acid monohydrate | Citric acid monohydrate | SNOWTEX N |
| Example 29 | Oxalic acid monohydrate | Citric acid monohydrate | SNOWTEX O |
| Example 30 | Oxalic acid monohydrate | Citric acid monohydrate | SNOWTEX NS |
| Example 31 | Oxalic acid monohydrate | Citric acid monohydrate | SNOWTEX OS |
| Comp. Ex. 1 | Oxalic acid monohydrate | Citric acid monohydrate | |
| Comp. Ex. 2 | Oxalic acid monohydrate | Citric acid monohydrate | |
| Comp. Ex. 3 | Oxalic acid monohydrate | Citric acid monohydrate | SNOWTEX N |
| Comp. Ex. 4 | Oxalic acid monohydrate | | SNOWTEX 30 |
| Comp. Ex. 5 | Oxalic acid monohydrate | | SNOWTEX NS |
| Comp. Ex. 6 | Oxalic acid monohydrate | | SNOWTEX O |
| Comp. Ex. 7 | Oxalic acid monohydrate | | SNOWTEX O |
| Comp. Ex. 8 | Oxalic acid monohydrate | | SNOWTEX 30 |
| Comp. Ex. 9 | Oxalic acid monohydrate | | SNOWTEX OS |
| Comp. Ex. 10 | Oxalic acid monohydrate | | SNOWTEX N |
| Comp. Ex. 11 | Oxalic acid monohydrate | | SNOWTEX O |
| Comp. Ex. 12 | Oxalic acid monohydrate | | SNOWTEX 30 |

TABLE 8

| Example | 1 | 2 | 3 | (wt %) 6 |
|---|---|---|---|---|
| C | 4.4 | 4.0 | 4.6 | 6.8 |
| O | 1.9 | 3.0 | 4.5 | 4.0 |
| Al | 0.7 | 0.9 | 1.0 | 1.2 |
| Si | 4.4 | 9.0 | 14.3 | 11.4 |
| Cr | 1.8 | 2.0 | 2.1 | 2.3 |
| Zn | 86.4 | 80.6 | 72.7 | 73.6 |
| Zr | 0.4 | 0.5 | 0.8 | 0.7 |
| Total | 100.0 | 100.0 | 100.0 | 100.0 |

TABLE 9

| Example | 8 | 16 | 18 | (wt %) 20 |
|---|---|---|---|---|
| C | 3.9 | 3.9 | 4.3 | 6.9 |
| O | 2.4 | 3.5 | 2.5 | 2.4 |
| Al | 0.7 | 0.8 | 0.8 | 0.8 |
| Si | 7.1 | 7.9 | 7.1 | 6.1 |
| Cr | 2.3 | 2.3 | 1.6 | 1.9 |
| Zn | 83.1 | 81.1 | 83.2 | 81.4 |
| Zr | 0.3 | 0.5 | 0.5 | 0.5 |
| Total | 100.0 | 100.0 | 100.0 | 100.0 |

TABLE 10

| Example | 21 | 22 | 23 | 24 | (wt %) 30 |
|---|---|---|---|---|---|
| C | 6.4 | 8.0 | 2.7 | 3.7 | 7.5 |
| O | 3.0 | 1.9 | 4.7 | 3.0 | 3.9 |
| Al | 0.9 | 1.3 | 1.9 | 1.0 | 1.1 |
| Si | 9.2 | 3.5 | 18.6 | 8.4 | 12.5 |
| Cr | 1.8 | 1.9 | 2.0 | 2.4 | 2.7 |
| Zn | 78.1 | 82.7 | 69.4 | 81.1 | 71.8 |
| Zr | 0.5 | 0.7 | 0.8 | 0.5 | 0.6 |
| Total | 100.0 | 100.0 | 100.0 | 100.0 | 100.0 |

TABLE 11

| Comp. Ex. | 1 | 2 | 3 | (wt %) 12 |
|---|---|---|---|---|
| C | 4.4 | 3.5 | 3.7 | 6.8 |
| O | 1.7 | 1.8 | 1.8 | 2.0 |
| Al | 0.0 | 0.7 | 0.0 | 0.8 |
| Si | 0.0 | 0.0 | 0.9 | 1.7 |
| Cr | 2.0 | 1.9 | 1.9 | 1.9 |
| Zn | 91.4 | 91.6 | 91.1 | 86.7 |
| Zr | 0.5 | 0.4 | 0.6 | 0.0 |
| Total | 100 | 100 | 100 | 100 |

What is claimed is:

1. A chemical conversion treatment solution comprising:
trivalent chromium ions;
zirconium ions;
aluminum ions;
at least one type of carboxylate ions; and
at least one type of silicon compounds, wherein
a content of the zirconium ions in the chemical conversion treatment solution is 0.01 to 5 mmol/L;
a content of the aluminum ions in the chemical conversion treatment solution is 0.01 to 0.30 g/L;
a total content of the silicon compound in the chemical conversion treatment solution is 0.5 to 11 g/L in terms of silicon; and
the chemical conversion treatment solution comprises no fluorine ions and fluorine compounds.

2. The chemical conversion treatment solution according to claim 1, wherein the at least one type of carboxylate ions comprise carboxylate ions capable of forming a complex with the trivalent chromium ions and carboxylate ions capable of forming a complex with the zirconium ions.

3. The chemical conversion treatment solution according to claim 1, wherein the at least one type of carboxylate ions comprise one or more types of carboxylate ions selected from the group consisting of dicarboxylate ions, hydroxy acid ions, and aldonic acid ions.

4. The chemical conversion treatment solution according to claim 3, wherein the dicarboxylate ions comprise one or more types of dicarboxylate ions selected from the group consisting of oxalate ions and malonate ions.

5. The chemical conversion treatment solution according to claim 3, wherein the hydroxy acid ions comprise one or more types of hydroxy acid ions selected from the group consisting of lactate ions, malate ions, citrate ions, tartrate ions, and glycolate ions.

6. The chemical conversion treatment solution according to claim 3, wherein the aldonic acid ions comprise one or more types of aldonic acid ions selected from the group consisting of gluconate ions, galactonate ions, and mannonic acid ions.

7. The chemical conversion treatment solution according to claim 1, further comprising at least one type of oxidizing agent.

8. The chemical conversion treatment solution according to claim 7, wherein the at least one type of oxidizing agent comprises nitric acid or a nitrate that supply nitrate ions.

9. The chemical conversion treatment solution according to any claim 1, comprising no cobalt ions and cobalt compounds and/or no hexavalent chromium ions.

10. The chemical conversion treatment solution according to claim 1, further comprising one or more types of preservatives selected from the group consisting of sorbic acid and salts thereof, isothiazolinone derivatives, dehydroacetic acid and salts thereof, and benzoic acid and salts thereof.

11. The chemical conversion treatment solution according to claim 1, further comprising one or more types of water-soluble metal salts comprising a metal selected from the group consisting of V, Ti, W, Zr, Mn, Mo, Ta, Ce, Sr, and Fe.

12. The chemical conversion treatment solution according to claim 1 further comprising one or more types of friction modifiers selected from the group consisting of surfactants and organic polymers.

13. The chemical conversion treatment solution according to claim 1, wherein the at least one type of silicon compound comprises colloidal silica.

14. The chemical conversion treatment solution according to claim 1, further comprising one or more types of organic acids or salts thereof selected from the group consisting of monocarboxylic acids or salts thereof, dicarboxylic acids or salts thereof, aromatic carboxylic acids or salts thereof, and amino acids or salts thereof.

15. A chemical conversion treatment method comprising bringing the chemical conversion treatment solution according to claim 1 into contact with a surface of a metal base material.

16. The chemical conversion treatment method according to claim 15, wherein the metal base material or the surface thereof is of zinc or a zinc alloy.

* * * * *